US010870999B1

(12) United States Patent
Oliphant et al.

(10) Patent No.: US 10,870,999 B1
(45) Date of Patent: Dec. 22, 2020

(54) METHOD FOR REPAIRING A DAMAGED HOLLOW POLE

(71) Applicant: Exo Group LLC, Magnolia, TX (US)

(72) Inventors: Wesley J Oliphant, Tomball, TX (US); Zachary James Oliphant, The Woodlands, TX (US); Garett William Oliphant, Spring, TX (US)

(73) Assignee: Exo Group, LLC, Magnolia, TX (US)

( * ) Notice: Subject to any disclaimer, the term of this patent is extended or adjusted under 35 U.S.C. 154(b) by 0 days.

(21) Appl. No.: 16/662,716

(22) Filed: Oct. 24, 2019

Related U.S. Application Data

(60) Provisional application No. 62/752,416, filed on Oct. 30, 2018.

(51) Int. Cl.
*E04G 23/02* (2006.01)

(52) U.S. Cl.
CPC ..... *E04G 23/0225* (2013.01)

(58) Field of Classification Search
None
See application file for complete search history.

(56) References Cited

U.S. PATENT DOCUMENTS 4,543,764 A * 10/1985 Kozikowski ..... E02D 5/60 405/216
4,779,389 A * 10/1988 Landers ..... E02D 27/42 405/216
4,892,601 A * 1/1990 Norwood ..... E04G 23/0218 156/94
4,921,555 A * 5/1990 Skiff ..... B29C 73/025 156/215
5,524,408 A * 6/1996 Richey ..... E02D 5/64 29/897.1
9,890,546 B2 * 2/2018 Ehsani ..... E04G 23/0225
10,227,789 B2 * 3/2019 Spangenberg ..... E04H 12/08
2002/0094239 A1 * 7/2002 Bradley ..... E04G 23/0225 405/216
2003/0145554 A1 * 8/2003 Young ..... E04G 23/0218 52/848
2003/0157281 A1 * 8/2003 Minayoshi ..... E04H 12/12 428/34.4
2003/0163960 A1 * 9/2003 Hadden ..... E04C 3/30 52/170
2005/0097855 A1 * 5/2005 Fouad ..... E04H 12/12 52/843
2011/0277410 A1 * 11/2011 Richardson ..... E04G 23/0218 52/426
2013/0014468 A1 * 1/2013 Ehsani ..... E04C 5/07 52/741.3
2017/0370118 A1 * 12/2017 Spangenberg ..... E04G 23/0218
2019/0119876 A1 * 4/2019 Grussenmeyer ..... E04C 5/06

* cited by examiner

*Primary Examiner* — Joshua K Ihezie
(74) *Attorney, Agent, or Firm* — Theresa Camoriano; Guillermo Camoriano; Duncan Galloway Egan Greenwald PLLC

(57) ABSTRACT

A method for making a field repair on a hollow pole includes installing a sleeve spaced outwardly from the hollow pole and extending from an elevation above the top elevation of the damaged portion down to the concrete foundation, filling the interior of the pole and the space between the pole and the sleeve with concrete from the foundation to an elevation above the top elevation of the damaged portion, which effectively extends the anchorline of the structure upwardly to encompass the damaged area of the structure.

6 Claims, 7 Drawing Sheets

METHOD FOR REPAIRING A DAMAGED HOLLOW POLE

BACKGROUND

The present invention relates to a method for repairing a hollow pole such as a pole for a power transmission line. More particularly, it relates to a method for repairing or reinforcing multisided poles wherein the main shaft has been damaged by an impact, such as when a vehicle hits the pole and dents it, or if the pole needs to be strengthened or needs better securing to its anchor point (foundation).

In a specific example of an application for this invention, a dump truck backed into and severely dented the shaft of a power transmission pole. The pole needed to be repaired in place, without taking the transmission line out of service.

SUMMARY

An embodiment of the present invention provides a method for field repairing a damaged hollow pole by extending the anchorline (foundation) to encase and strengthen the damaged area of the pole.

DESCRIPTION

Figure 1:
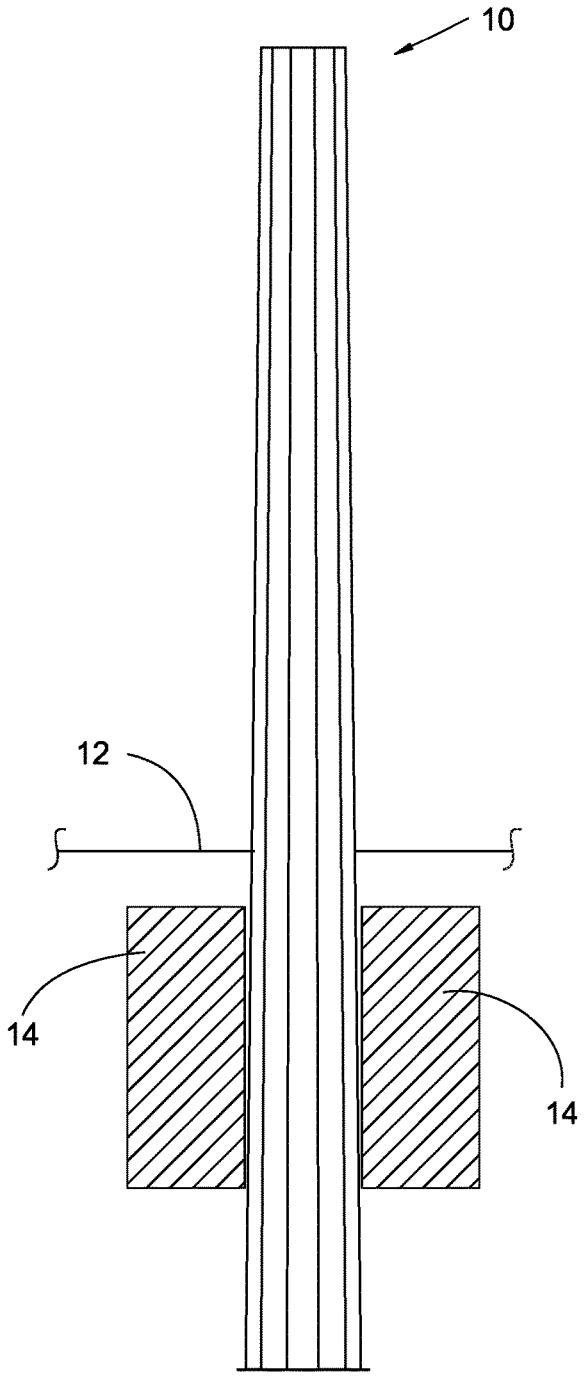
FIG. 1 is a schematic side view of a prior art multi-sided pole showing the groundline as well as the anchoring base or foundation (shown in section)
Figure 1A:
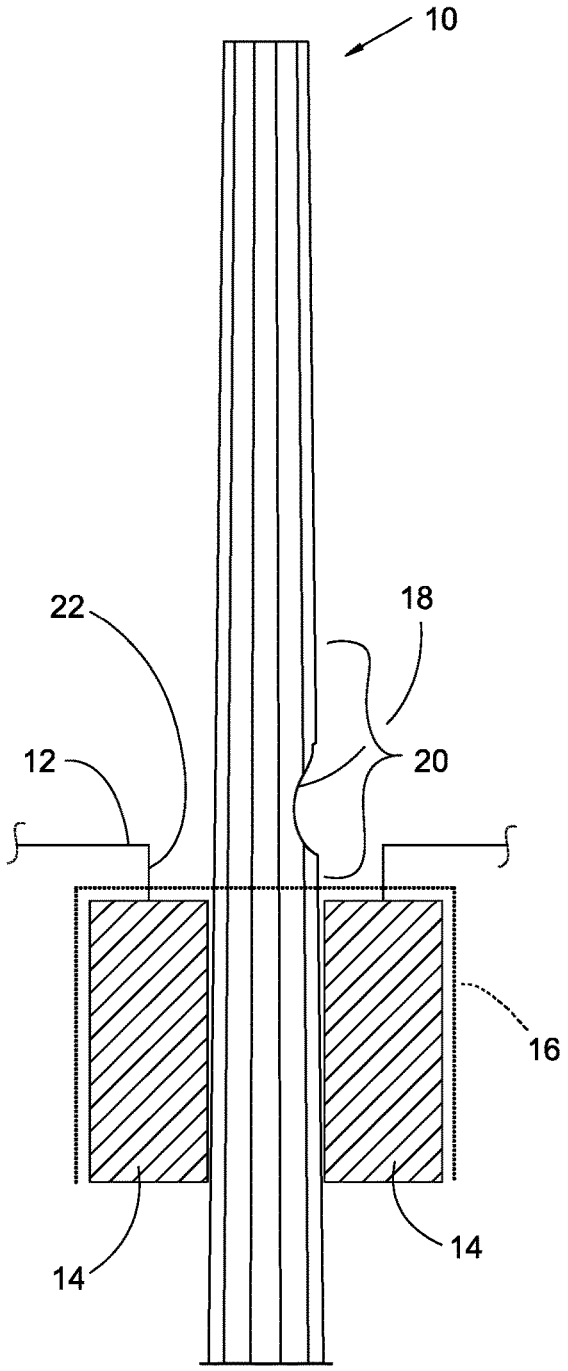
FIG. 1A is a side view of the prior art multi-sided pole of FIG. 1 showing damage from an impact which dented a portion of the pole and showing an imaginary line depicting the anchoring line securing the pole to the ground.
Figure 2:
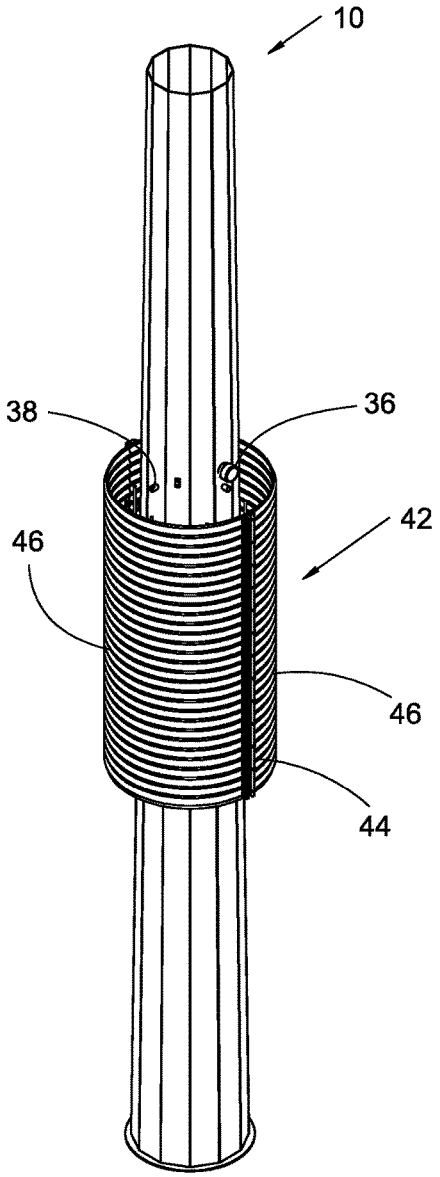
FIG. 2 is a perspective view of the pole of FIG. 1A (the anchor base and the groundline have been omitted for clarity) being repaired in accordance with an embodiment of the present invention.

FIGS. 1 and 1A are side views of a prior art hollow, multi-sided pole 10. The lower portion of the pole 10 is buried into the ground below the groundline 12 and is anchored to the ground by being embedded in a concrete base 14 (shown in cross-section), which defines an anchorline 16 (a line along the outside of the concrete base or foundation 14). FIG. 1A further depicts a damaged area 18, and the number 20 (See also FIG. 5) indicates the area surrounding and including the damaged area 18, where the repair takes place in accordance with an embodiment of the present invention as described in more detail below. The area 20 where the reinforcement or repair takes place encompasses the damaged area 18. It should be noted that, in a preferred embodiment, the repair is made using a corrugated, cylindrical sleeve 42, as shown in FIG. 2. However, the repair may be made using another shaped sleeve, such as a square cross-section sleeve or an octagon-cross-section sleeve which may or may not be corrugated.

The initial preparation for the repair involves digging a hole 22 (See FIG. 1A) in the ground around the pole 10 until the top surface of the concrete anchoring base 14 is at least partially uncovered. Then, and referring now to FIGS. 4-6A, a plurality of laterally-extending, threaded reinforcing rods 28 are installed on the pole 10 in the repair area 20 encompassing the damaged area 18, from a point at an elevation above the top elevation of the damaged area 18 to a point at or below the bottom elevation of the damaged area 18. As shown in FIG. 6, through openings 24 are drilled through the wall of the pole 10. A nut 26, with a nut-thread diameter slightly smaller than that of the openings 24 is securely attached to the outside of the pole 10 (as by welding for instance) at each opening 24. Next, a threaded reinforcing rod 28 is threaded into each of the nuts 26 such that the threaded reinforcing rod 28 extends laterally inwardly into the pole 10 for a distance "Din" (See FIG. 6), and the rest of the threaded reinforcing rod 28 extends laterally outwardly from the wall of the pole 10 such that the head or outer end 30 of the threaded reinforcing rod 28 lies a distance "bout" outside of the pole 10. In this particular embodiment, the reinforcing rods 28 are 12 inches long and, once installed laterally through the pole 10 and secured to the pole 10, they project inwardly approximately 5 inches and outwardly approximately 7 inches. Of course, different sizes of reinforcing rods could be used, depending upon the application. Also, the reinforcing rods need not be threaded and secured to the wall of the pole 10 by means of a nut welded to the pole 10. Various other securement means could be used, such as securing with a different type of fastener or securing by welding the reinforcing rods to the wall of the pole 10. These laterally-extending, threaded reinforcing rods 28 act as shear connectors between the concrete and the pole 10 both on the inside and outside of the pole 10, as described in more detail later.

Figure 4:
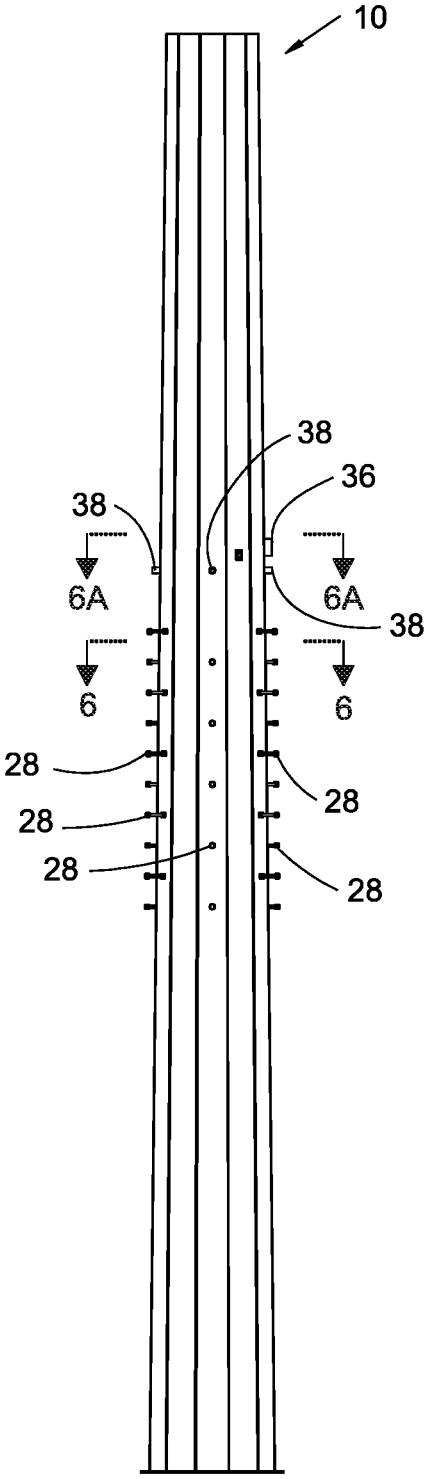
FIG. 4 is a side view of the pole of FIG. 1A (the anchor base and the groundline have been omitted for clarity) showing a preliminary preparation of the pole of FIG. 2 prior to concreting it in for reinforcement.
Figure 5:
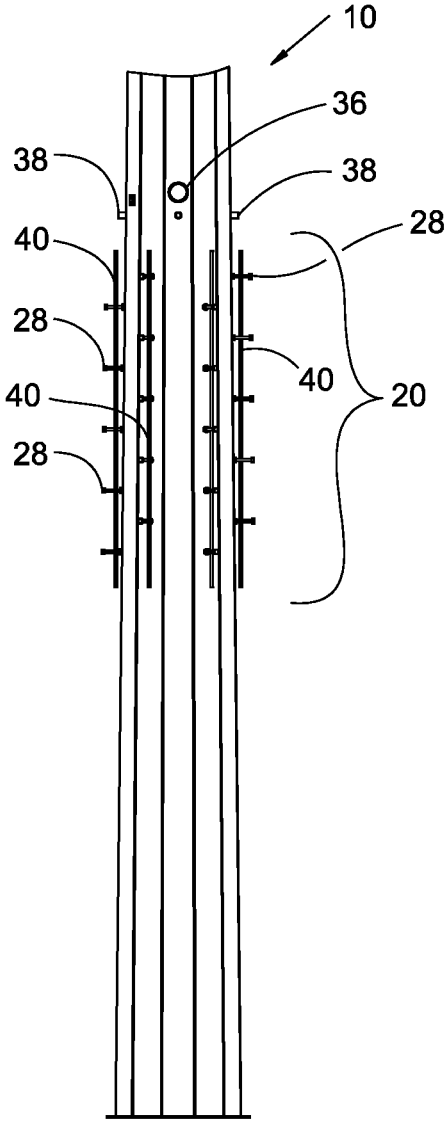
FIG. 5 is a broken-away, front view of the pole of FIG. 4, rotated 90 degrees along its longitudinal axis from FIG. 4.
Figure 6:
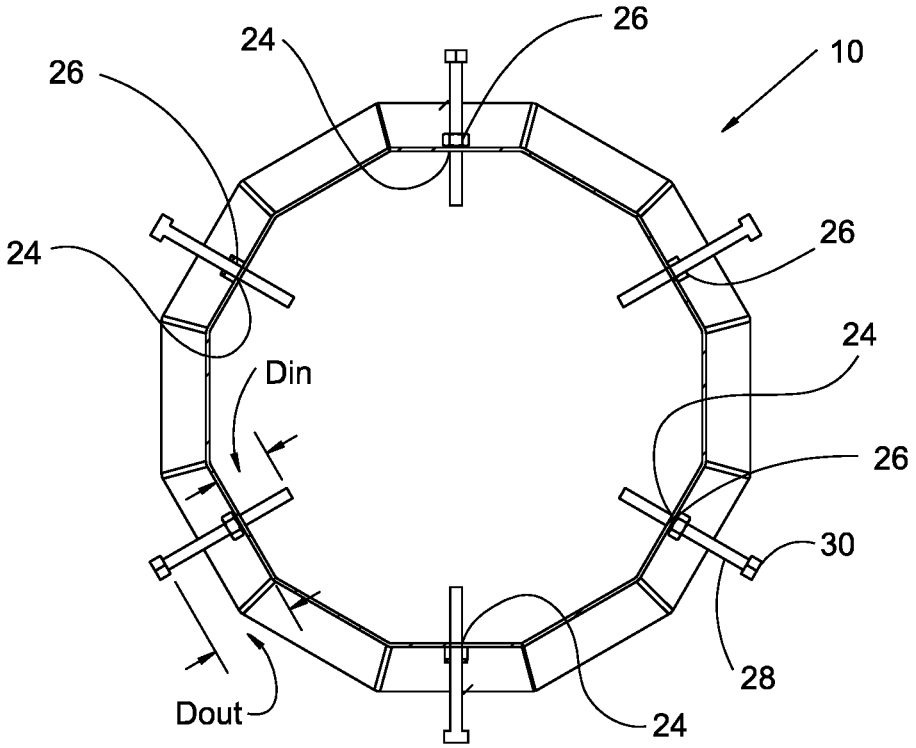
FIG. 6 is a view along line 6-6 of FIG. 4.

Referring to FIGS. 4 and 5, it may be appreciated that the laterally-extending reinforcing rods 28 are installed on the wall of the pole 10 in a vertically-aligned and horizontally staggered arrangement. In this embodiment, the rods 28 on a first face of the pole 10 begin at a first elevation above the top elevation of the damaged portion 18 and are equally-spaced and aligned along a vertical line. The rods 28 on the third face of the pole 10 (skipping one face from the first face) begin at a second elevation, offset from the first elevation, and have the same spacing and vertical alignment as the rods 28 on the first face. The rods 28 on the fifth face of the pole begin at another elevation, and have the same spacing and again are aligned along a vertical line. This creates the vertically-aligned and horizontally-staggered arrangement, with the laterally-extending reinforcing rods 28 extending in a variety of radial directions. In this embodiment, the rods 28 are installed on every other face (See FIG. 6) of the multi-sided pole 10. Once the rods 28 are installed, a plurality of upright reinforcing rods 40 (See FIG. 5) are secured to the lateral rods 28 (typically by wiring them or welding them to the rods 28), and wires 41 are wrapped around and extended between the upright reinforcing rods 40 to form a wire mesh reinforcing cage surrounding the outer surface of the pole 10 to reinforce the concrete which will be poured around the outside of the pole 10, in the void between the pole 10 and the sleeve 42, as described in more detail later. The upright rods 40 are spaced outwardly away from the wall of the pole 10 and inwardly away from the inner surface of the wall of the sleeve 42. In this particular embodiment, the upright rods 40 are spaced a distance of approximately 6 inches outwardly from the wall of the pole 10 and a distance of at least 6 inches inwardly from the inner surface of the wall of the sleeve 42. However, the distances may vary as desired.

Figure 6A:
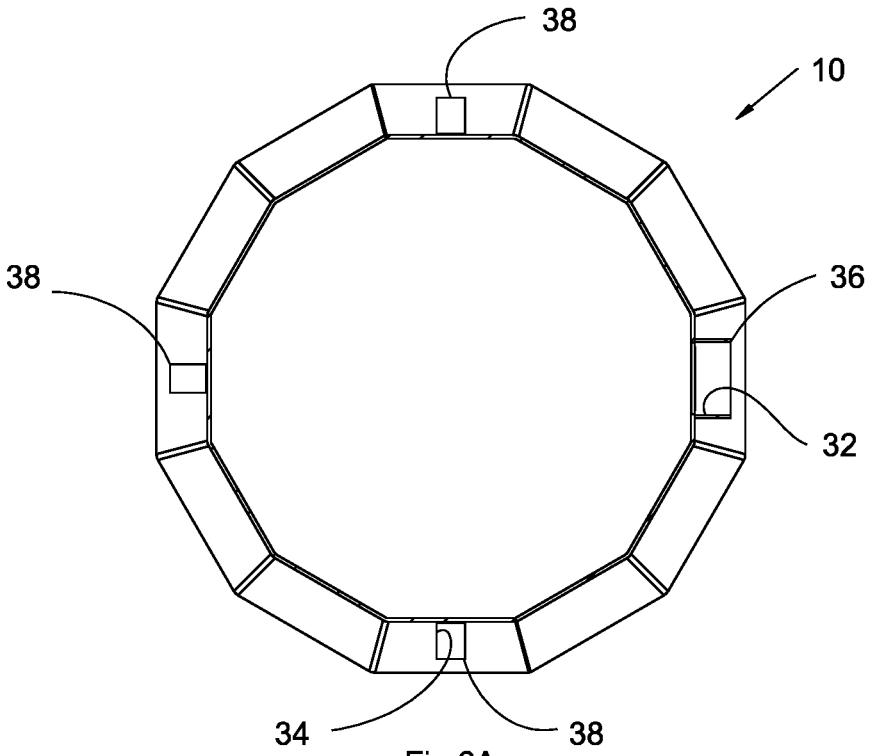
FIG. 6A is a view along line 6A-6A of FIG. 4.

Referring to FIGS. 4, 5, and 6A a plurality of through openings is drilled through the wall of the pole 10 at an elevation which is just above the area 20 of the repair (above the top elevation of the damaged section 18). A first through opening (inlet opening) 32 is drilled and receives a 6 inch diameter, 3 inch long hollow coupling 36 through which concrete is to be pumped into the hollow pole 10, as described in more detail later. Three other through openings 34 are drilled to receive hollow couplings 38 that have a 2 inch diameter and are 3 inches long. These smaller hollow couplings 38 provide overflow openings through which the concrete which is pumped into the pole 10 may overflow, as described in more detail later. The dimensions and distances described above and throughout the description are intended to be an example, and it is understood that other dimensions and distances could be used.

A barrier protection (not shown) may be installed (or painted on) the outer wall of the pole 10, extending at least from the anchoring base 14 to the topmost elevation where concrete will be poured between the outer walls of the pole 10 and the sleeve 42.

Figure 3A:
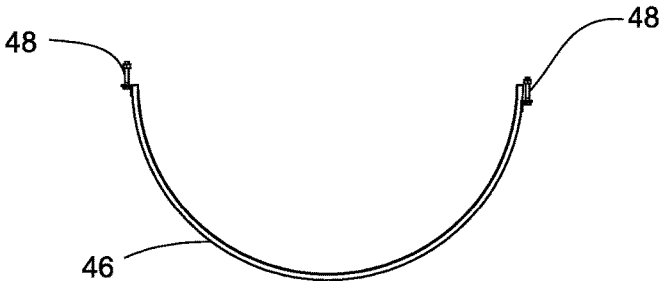
FIG. 3A is a top view of the corrugated metal sleeve section of FIG. 3.
Figure 3:
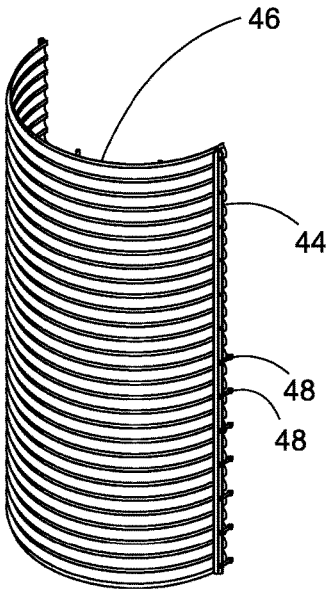
FIG. 3 is a perspective view of the semi-cylindrical section of a corrugated metal sleeve used in the repair of FIG. 2.
Figure 7:
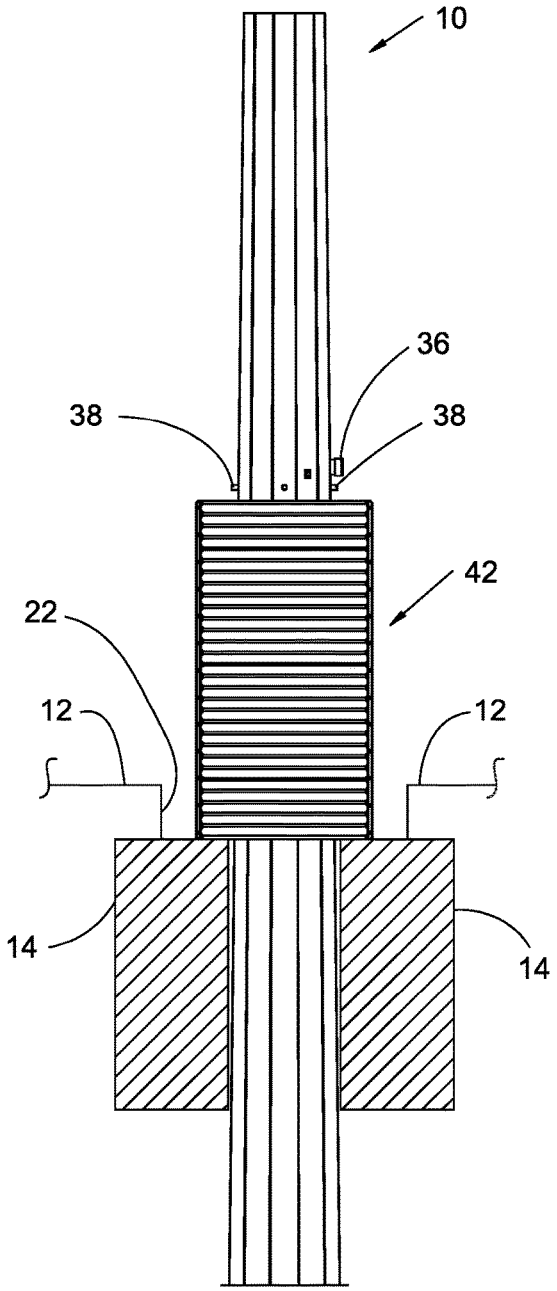
FIG. 7 is a side view, similar to that of FIG. 1A, showing the corrugated metal sleeve installed in preparation for pouring the reinforcement concrete.
Figure 8:
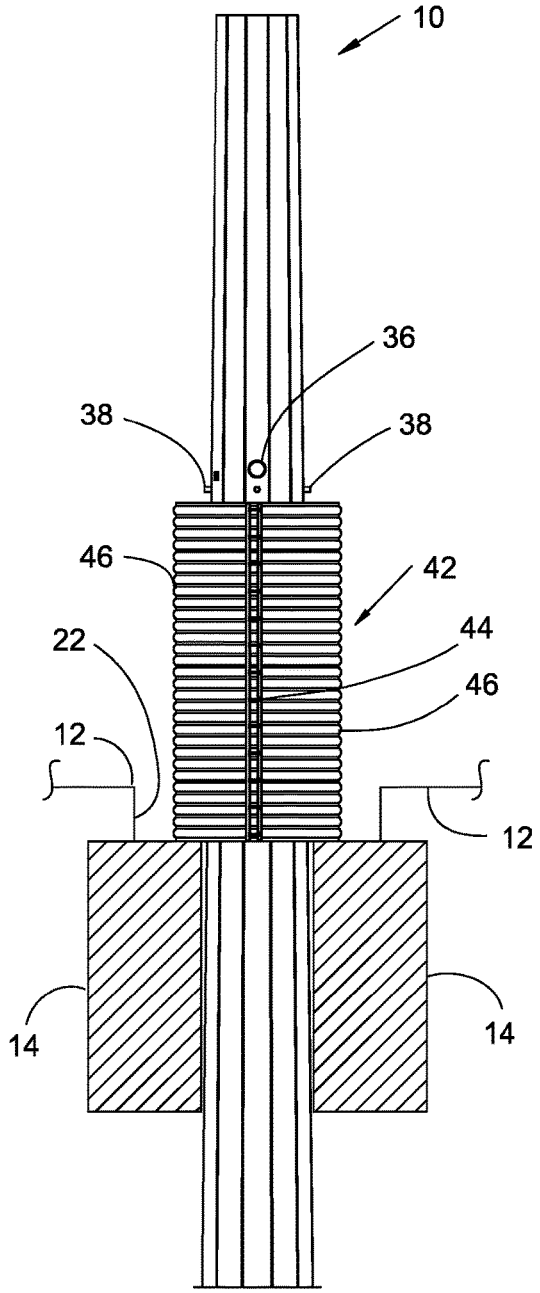
FIG. 8 is a front view of the pole of FIG. 7, rotated 90 degrees along its longitudinal axis from FIG. 7.

Referring now to FIGS. 2, 3, and 3A, the repair area 20 of the pole 10 is then encased in a sleeve 42. In a preferred embodiment, the sleeve 42 is a 12 gauge (approximately 7/64 inch thickness) corrugated metal sleeve. The sleeve 42 is first cut in half lengthwise and a 2"×2"×¼" angle 44 is attached (as by welding) to each vertical edge of the sleeve halves 46 (see FIGS. 3 and 3A). Once the sleeve halves 46 are installed around the circumference of the pole 10 at area 20 where the repair is to be effected, the sleeve halves 46 are bolted together with bolts 48 so as to encase the pole 10 at the repair area 20, as shown in FIG. 2. The length of the sleeve 42 is selected so that the sleeve 42 rests on top of the anchoring base 14 (See FIGS. 7 and 8) and so that the sleeve 42 surrounds the damaged area 18, and surrounds the repair area 20 that is to be encased in concrete. The top edge of the sleeve 42 is below the elevation of the concrete inlet coupling 36 as well as below the concrete overflow couplings 38 (See FIGS. 4 and 5). The cage formed by the upright rods 40, lateral rods 28, and connecting wires extends the length of the sleeve 42.

Next, as much pumpable concrete as is required to fill the hollow volume inside of the pole 10 up to the overflow couplings 38 is injected through the opening 32. Once the desired concrete level inside the pole 10 is reached, the opening 38 may be closed by installing a pipe cap (not shown) over the outer end of the coupling 36.

Next, concrete is pumped in to fill the void between the wall of the pole 10 and the inner surface of the sleeve 42 extending the full elevation of the sleeve 42. This concrete also surrounds the cage formed by the lateral rods 28, upright rods 40 and wires. The top surface of the poured concrete between the outer surface of the wall of the pole 10 and the inner surface of the sleeve 42 is preferably sloped away from the pole 10 to allow water to run off.

Figure 9:
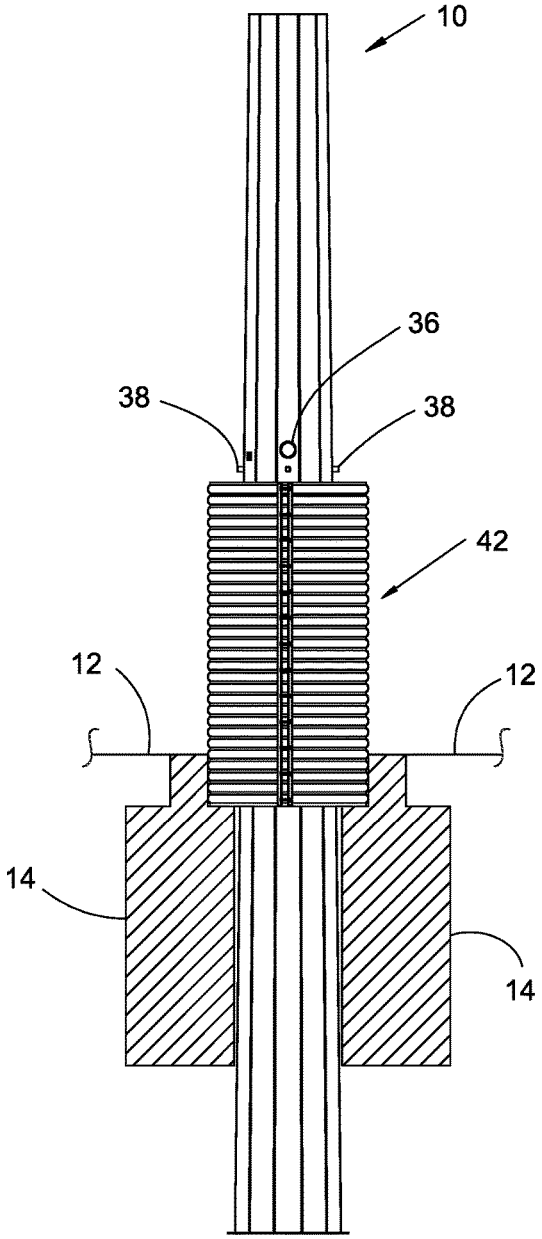
FIG. 9 is a front view, similar to that of FIG. 8 but showing the completed repair on the damaged pole.
Figure 9A:
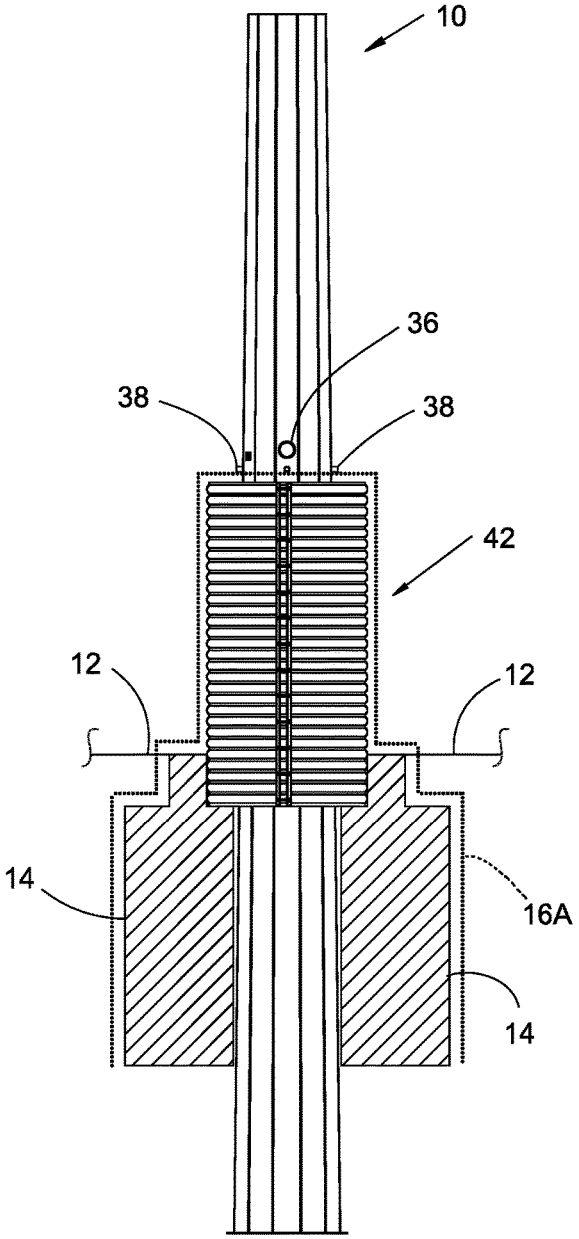
FIG. 9A is a front view, identical to that of FIG. 9, but showing an imaginary line depicting the new anchoring line securing the pole to the ground.
Figure 10:
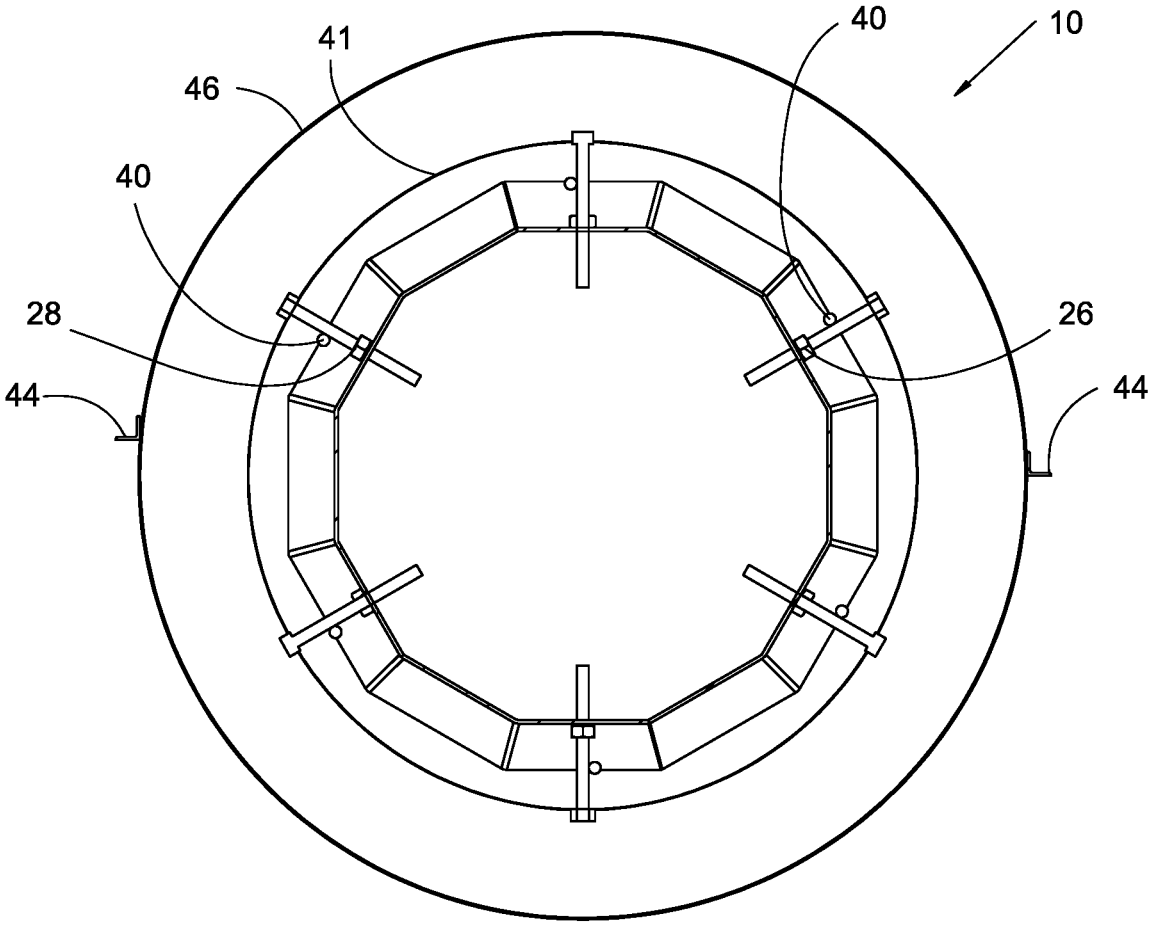
FIG. 10 is a top section view similar to FIG. 6, but through the finished, repaired pole.

Finally, what remains of the hole 22 is filled in, preferably with concrete, up to the groundline 12 elevation. (See FIGS. 9 and 9A.)

This moves the anchorline 16 from the original position shown in FIG. 1A up above the groundline 12 to the top of the sleeve 42, so that the new anchorline 16A encompasses the damaged area 18. In addition, the inside of the pole 10 is filled with concrete to at least the elevation of the anchorline 16A, with laterally-extending rods 28 and upright rods 40 embedded in the concrete and tying the concrete area on the interior of the pole 10 and the concrete area on the exterior of the pole 10 together to provide a strong and permanent repair of the pole 10. It should be noted that, while the concrete base in this embodiment is below ground level, this same repair could be made with the concrete base being at or above ground level.

While the embodiment described above shows a multi-sided hollow pole, this repair also could be made to a circular-cross-section pole or other cross-section pole. Also, the arrangement of laterally-extending reinforcing rods 28, upright reinforcing rods 40, and other reinforcement may be modified as desired for the particular situation.

While the invention described above shows one embodiment of a method for effecting a field repair on a damaged or weakened hollow pole, it will be obvious to those skilled in the art that modifications may be made to the embodiment described above without departing from the scope of the present invention as claimed.

What is claimed is:

1. A method for repairing a hollow pole embedded in a concrete foundation, said hollow pole having a pole wall defining an interior and an exterior and having a damaged area extending downwardly from a top elevation to a bottom elevation, comprising the steps of:

installing laterally-extending reinforcing rods through the pole wall at a plurality of elevations and at a plurality of radial positions from above the top elevation to below the bottom elevation of the damaged area;

installing a sleeve spaced outwardly from said laterally-extending reinforcing rods and extending from above said top elevation to said concrete foundation;

pouring concrete into the interior of the hollow pole to fill the interior of the hollow pole to an elevation above the top elevation of the damaged area; and pouring concrete to fill the space between said sleeve and said pole wall from said concrete foundation to above said top elevation.

2. A method for repairing a hollow pole embedded in a concrete foundation as recited in claim 1, and further comprising the step of securing a plurality of upright reinforcing rods to said laterally-extending reinforcing rods and forming a cage between said pole wall and said sleeve before pouring concrete to fill the space between said sleeve and said pole wall.

3. A method for repairing a hollow pole embedded in a concrete foundation as recited in claim 2, and further comprising the step of securing said laterally-extending reinforcing rods to said pole wall by threading said laterally-extending reinforcing rods through respective nuts secured to said pole wall.

4. A method for repairing a hollow pole embedded in a concrete foundation as recited in claim 3, wherein said laterally-extending reinforcing rods have an enlarged head at their outer end.

5. A method for repairing a hollow pole embedded in a concrete foundation as recited in claim 4, and further comprising the step of installing a fitting through a first hole in said pole wall above said top elevation, and using said fitting to pour concrete into the interior of said pole.

6. A method for repairing a hollow pole embedded in a concrete foundation as recited in claim 5, and further comprising the step of, when filling the interior of said hollow pole with concrete, waiting until the concrete begins to flow out of a second hole in said pole wall above said top elevation to ensure that concrete has filled the interior of said pole up to the elevation of said second hole, and then stopping the concrete flow into the interior of the pole.

* * * * *